United States Patent [19]

Brandmair et al.

[11] 4,078,988

[45] Mar. 14, 1978

[54] ELECTRODE FOR ELECTROCHEMICAL PROCESSES AND METHOD OF PRODUCING THE SAME

[75] Inventors: Franz Brandmair, Rain, Lech; Ottmar Rubisch, Meitingen bei Augsburg; Dietmar Honig, Augsburg, all of Germany

[73] Assignee: Sigri Elektrographit GmbH, Meitingen, Germany

[21] Appl. No.: 765,899

[22] Filed: Feb. 7, 1977

Related U.S. Application Data

[62] Division of Ser. No. 541,348, Jan. 15, 1975, Pat. No. 4,029,566.

[30] Foreign Application Priority Data

Feb. 2, 1974 Germany ..... 2405010

[51] Int. Cl.$^2$ ..... C25B 11/10; C25B 1/36

[52] U.S. Cl. ..... 204/286; 204/99; 204/128

[58] Field of Search ..... 204/286, 288 , 290 R, 204/290 F, 291

[56] References Cited

U.S. PATENT DOCUMENTS

| | | | |
|---|---|---|---|
| 2,783,196 | 2/1957 | Raney | 204/64 |
| 3,318,792 | 5/1967 | Cotton et al. | 204/219 |
| 3,458,423 | 7/1969 | Csizi | 204/219 |
| 3,663,280 | 5/1972 | Lee | 427/126 |
| 3,839,179 | 10/1974 | Kosiol et al. | 204/219 |
| 3,846,273 | 11/1974 | Bianchi et al. | 204/290 F |
| 3,951,767 | 4/1976 | Lohrberg et al. | 204/99 |

*Primary Examiner*—F.C. Edmundson
*Attorney, Agent, or Firm*—Herbert L. Lerner

[57] ABSTRACT

Electrode for electrochemical processes has a base formed of passivatable material, and a covering layer of activating substance at least partly covering the base, the material of the base consisting of titanium oxide $TiO_x$, wherein $x = 0.25$ to 1.50; and method of producing the same.

10 Claims, 4 Drawing Figures

Fig. 2
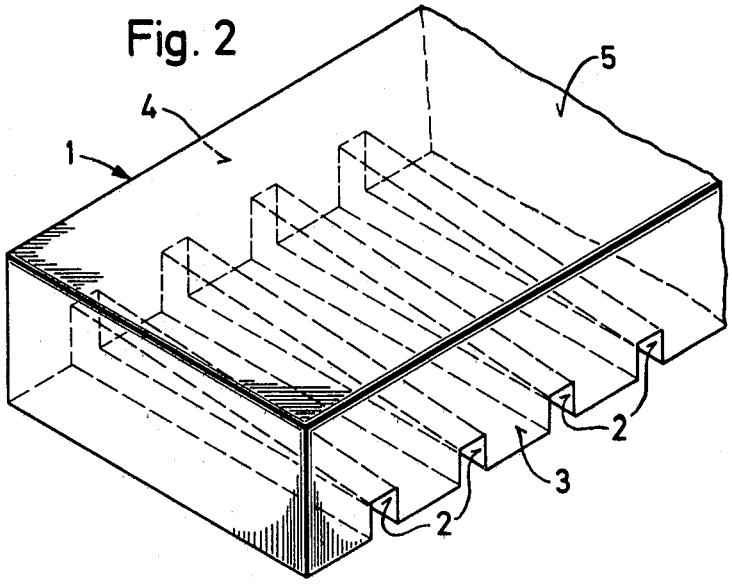
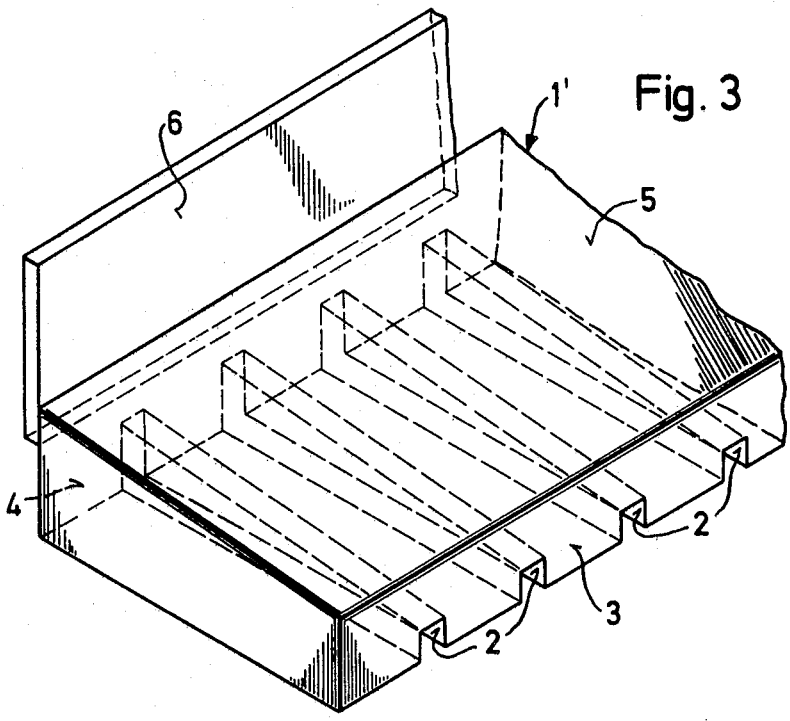
Fig. 3

ELECTRODE FOR ELECTROCHEMICAL PROCESSES AND METHOD OF PRODUCING THE SAME

This is a division of Ser. No. 541,348 filed Jan. 15, 1975, now U.S. Pat. No. 4,029,566.

The invention relates to an electrode for electrochemical process and, more particularly, to such an electrode having a base formed of passivatable material and a covering layer of activating substance at least partly covering the base, and to a method of production of such an electrode.

Numerous electrochemical processes have been introduced in the field of engineering, for example, for producing chlorine and alkalis from salt solutions in quicksilver — or diaphragm cells, chlorates, hypochlorides and the like, for oxidation of organic substances, for desalinization of, for example, sea water, and for protection against cathodic corrosion. It has been known heretofore, to employ cathodes and anodes of graphite or impregnated graphite for such electrochemical processes, wherein the graphite anodes are depleted or reduced by electrochemical reaction so that n order to maintain a constant spacing between the electrodes, the anodes must be adjusted periodically and finally replaced. In addition, it has become known, heretofore, to produce anodes of passivatable metals, such as titanium, zirconium, niobium, tantalum, tungsten, aluminum, iron, nickel, lead and bismuth, for example, which are virtually stable under electrolysis conditions i.e. the dimensions thereof virtually remain unchanged. The preferably oxidic passivating layer that forms on the surface of such a metal anode lends to the anode an outstanding durability or stability against corrosive attack, however, due to its relatively great electrical resistance, it simultaneously effects a marked increase in voltage drop. To avoid this disadvantage, it has become known to provide metal anodes with covering layers containing activating substances, such as platinum metal, compounds of platinum metal alone or together with oxides of non-noble metals, such as manganese, lead, titanium or tantalum. Moreover, the provision of a covering layer with numerous other compounds, such as carbides, borides, sulfides, phosphides and mixed oxides, has also been proposed heretofore.

Essential criteria for the utility of a covering layer are durability or stability in the respective electrolyte, resistance to erosion or corrosion, and especially the adhesion of the layer to the electrode base. Numerous methods of improving the adhesive strength have become known which are determined essentially by the type of coating or layer-forming process, the composition of the covering layer substance, and the characteristics of the surface to be coated. It has also been known to dispose an additional intermediate layer between the base and the covering layer as "adhesion helper" or "intermediary". Partial loosening or detachment of the covering layer cannot be eliminated, however, with the heretofore known types of base-covering layer pairings. The connection between the electrode base and the current supply rods formed, for example of titanium, which are in turn electrically connected through busbars or conductor bars to a rectifier is essential for the utility of the electrodes. The quality of the mechanical and electrical connection is not ultimately determined by the weldability or solderability of the materials used for producing electrode bases and current or power supply rods.

In performing electrochemical reactions, it is generally advantageous to remove the reaction products rapidly and as completely as possible from the electrode surfaces and to ensure simultaneously the constant and intensive supply of fresh electrolyte, in order to avoid impairment of the efficiency of the reactions.

In the aqueous electrolysis of alkali halogenides according to the quicksilver method, the voltage drop of the cell, for example, is increased to an undesired extent by gas bubbles and gas films adhering to the anode surface. To avoid this effect, numerous forms of anodes having bases of graphite or of solid metals, such as titanium, for example, and which promote the loosening and transport of the gas bubbles, have been proposed heretofore. However, they have proven to be of limited suitability because of the required, relatively high processing expense for electrodes of a sintered metal or of a metallic compound.

It is accordingly an object of the invention to provide an electrode for electrochemical processes wherein the adhesion of the covering layer to the electrode base is so improved that reductions in the electrochemical activity of the electrode due to partial loosening or detachment of the covering layer are completely avoided.

It ia another object of the invention to provide such an electrode with a mechanical and electrical connection between the electrode base and power supply rods of titanium, which are, in turn, connected by conductor bars to a rectifier, that is much improved in durability over that of the heretofore known devices of this general type.

It is a further object of the invention to provide an electrode of the foregoing type which is of relatively simple construction and in which there is a marked reduction of gas bubble polarization as compared to heretofore known electrodes of this type.

It is yet another object of the invention to provide a method of producing such an electrode that employs relatively simple and inexpensive means.

With the foregoing and other objects in view, there is provided in accordance with the invention, an electrode for electrochemical processes comprising a base formed of passivatable material, and a covering layer of activating substance at least partly covering the base, the material of the base consisting of titanium oxide $TiO_x$, wherein $x = 0.25$ to 1.50.

In accordance with a preferred embodiment of the invention, $x = 0.42$ to 0.60.

In accordance with another feature of the invention, 20 to 50% by volume of the base is formed of pores having a mean diameter of 0.5 to 5 mm.

In accordance with a further feature of the invention, the electrode base has a surface facing away from the covering layer, that surface being provided with a layer of metallic sintered titanium to improve the weldability and solderability thereof.

In accordance with an additional feature of the invention and to minimize gas bubble polarization, the electrode of the invention is provided with a rectangular bottom surface wherein a series of slots of uniformly increasing depth are formed extending from side to opposing side of the electrode.

In accordance with an added feature of the invention, the electrode has a top surface that is inclined with respect to the bottom surface thereof.

In accordance with yet another feature of the invention, the slots are defined by surfaces extending vertically along respective edges formed at the bottom surface of the electrode, the edges formed between the vertical surfaces of the slots and the bottom surface being rounded.

In accordance with still another feature of the invention, a shield is mounted at the side of the electrode at which the slots are deepest and extends a given vertical distance so as to be just below a desirable electrolyte surface level.

In accordance with a concomitant feature of the invention, the electrode base is formed with a bottom, a top and a lateral surface, at least one of the surfaces being provided with rib-like reinforcing members.

In accordance with one mode of the method of producing the electrode for electrochemical processes according to the invention, the following steps are performed: mixing titanium powder and titanium dioxide powder in a ratio of 7 : 1 to 1 : 3, adding a binding agent thereto, compressing the resulting mixture and sintering it at temperature of 1200° to 1400° C in an argon atmosphere, and coating the thus compressed and sintered body with a covering layer containing an activating substance.

In accordance with another mode of the method of the invention, after forming the foregoing compressed and sintered body and before performing the coating step, the method includes the steps of: comminuting the compressed and sintered body into $TiO_x$ powder, compressing the $TiO_x$ powder at pressures of 300 to 2500 kp/cm$^2$ into a plurality of molded members, sintering the molded members at temperature of 1200° to 1400° C, and then coating the sintered molded members with the layer of activating substance.

In accordance with a further mode of the method, a layer of $TiO_x$ powder is covered with a layer of titanium powder and compressed with pressure of from 300 to 3000 kp/cm$^2$ (kilopond per square centimeter), molded and sintered by heating in an inert gas atmosphere to a temperature of from 1100° to 1400° C, and after cooling the sintered body, applying to the free $TiO_x$ surface thereof a covering layer containing an activating substance.

More specifically, to produce the base of the electrode of the invention, titanium metal and titanium oxide, both in powder form, are mixed in a ratio of 7 : 1 to 1 : 3, if desired, after adding thereto an aqueous solution of polyvinyl alcohol for example; the mixture is then compressed into plates, rods or members having other shapes suitable as electrodes; and the thus-formed compressed or molded members are then sintered in an inert atmosphere in the temperature range of 900° to 1500° C.

Mixtures with relatively higher oxygen content are expediently sintered at higher temperatures than oxygen-poorer mixtures. To improve the uniformity or homogeneity of the sintered $TiO_x$ members, a two-stage production method may be of advantage wherein the sintered molded members formed in the just-described manner are comminuted and ground, and the powdered thereby obtained, if desired after the addition thereto of a compression supplement such as paraffin, wax, polyethylene, polytetrafluorethylene and the like, is compressed into plates or rods. Through expediently shaped press dies, reenforcement ribs and/or recesses interspersing the electrode base and serving as gas discharge or escape channels, are impressed into the plates or rods. The molded members are then heated in a protective gas, such as argon for example, to a temperature of about 1200° to 1400° C.

Through the single or double heat treatment of the compressed Ti—$TiO_2$ powder mixture, substantially uniform TiO-phases corresponding to the respective stoichiometric composition are formed, the crystal lattices of which are considerably disrupted. Thus, for example, in the range $x = 0.6$ to 1.25, a compound of the NaCl-type with a lattice replete with a multiplicity of gaps exists, in the range $x < 0.42$, the $\alpha$-titanium lattice is expanded by occluded oxygen, and in the ranges $x = 0.42$ to 0.60 or $x = 1.25$ to 1.50, the electrode base is formed of mixtures of the disrupted $\alpha$-Ti and TiO-phases or the TiO and $Ti_2O_3$-phases.

In accordance with a further embodiment of the invention, the porosity of the base is about 20 to 50% by volume. To produce a porous base, sintered pre-molded members having the composition $TiO_x$, wherein $x = 0.25$ to 1.50, are comminuted, fractions thereof having grain sizes between 1 and 12 mm, that are obtained by means of sieves, are compressed, and are then heated, for example, in an argon atmosphere to about 1200° to 1400° C. The mean pore diameter is expediently substantially 0.5 to 5mm. The large outer surface of such a base affords the impingement thereon of very large currents without damage to the covering layer. Of further advantage are the numerous, statistically uniformly distributed pores interspersed through the base and serving as gas discharge or escape channels, and the relatively low weight of a porous base.

To supply current to the electrode of the invention, one or more titanium rods are secured to the base and are, in turn, connected through current conductors or rails, for example, to a rectifier. To produce the connection between the current supply rods and the base, conventional methods such as hard soldering and especially welding are of little suitability for electrode bases of $TiO_x$ wherein $x = 0.25$ to 1.50, because, even with careful handling, cracks or tears in the solder layer or in the welding seam and also in the base are unavoidable, and the drop in voltage due to these defects increases to undesired high values during operation of the electrode. The weldability and solderability of the electrode base is improved in accordance with the invention by applying to a surface of the molded member a layer of titanium powder mixed with a binding agent, such as etherized cellulose, by means of a spatula or also by compression and then firmly bound to the $TiO_x$ base by sintering at a temperature of about 1200° C in an argon atmosphere. In accordance with other modes of the method of the invention, the titanium layer is applied to the base by flame-spraying or plasma-spraying.

The electrodes can also be produced by compressing porous or spongy titanium into plate-shaped members, covering the lattice with a powder mixture of titanium- and rutile powder, or with a $TiO_x$-powder, and then sintering the powder-covered members at a temperature of about 1100° to 1400° C. In accordance with a preferred mode of the method of producing the electrode of the invention, a layer of $TiO_x$-powder is covered with a layer of titanium powder in a die, then both layers at pressures of from 300 to 3000 kp/cm$^2$ are compressed, molded and sintered.

The sintered base is then provided with a covering layer which contains at least one metal of the group platinum, palladium, iridium, ruthenium, osmium, rhodium, gold and silver or of a compound of these metals, such as an oxide, nitride or sulfide thereof. Suitable methods of applying the covering layer are, for example, precipitation from solutions, the spreading on of a suspension, galvanic deposition, plasma-spraying, flame-spraying or pyrolytic deposition from the gas phase. The covering layer which is baked or burned on by heating to about 300° to 600° C, should cover at least 5% of the surface of the electric base and should have a thickness of about 0.5 to 10 μm.

The covering layer of electrodes according to the invention, is firmly anchored in the disrupted crystal lattice of the base material so that, even after repeated tampering with subsequent quenching of the electrode, no loosening of the layer nor reduction of the electrochemical activity is detectable. Abrasion of the covering layers under erosive or corrosive conditions, as are present, for example, in electrolyte cells with rapidly flowing electrolyte, is extraordinarily low. The fissured porous surface of the base is, in addition, considerably larger than the surface of a solid metal electrode of corresponding dimensions so that, per unit of area, a larger quantity of activating substance can be applied and the electrode can be subjected to a greater current density without damaging the activating subtance.

A further advantage of the electrode of the invention is that gas discharge or escape channels, reenforcing ribs and the like can be impressed into the base during the production thereof, thereby dispensing with any additional subsequent machining or other operation.

Electrodes produced in accordance with the invention are advantageously formed with three layers, a first layer facing toward the electrolyte, containing noble metals or compounds of noble metals, a second layer of a titanium oxide $TiO_x$ wherein $x = 0.25$ to 1.50, and a third layer of titanium. The layers are connected one to another so as to be mechanically undetachable or unloosenable, the middle layer essentially assuring the firm anchoring of the first layer to the electrode base and the third layer assuring the weldability of the base to the current supply rods of titanium. The electrode of the invention thus combines the advantage of a base of metallic titanium with respect to weldability with the advantages of a base of $TiO_x$ with respect to the firm bonding of the covering layer. The thickness of the $TiO_x$ and Ti-layers forming the base, and the ratio of the thickness of both layers is determined exclusively by their functional efficiency, by which is to be understood mechanical stability and the weldability of the base as well as the bonding of the covering layer. Advantageously, the thickness ratio is substantially from 10 : 1 to 1 : 10. Porosity and pore size distribution are variable and can be matched to the respective operating conditions by varying the grain size of the powder being used as well as the compression and sintering conditions, for example for the formation of suitable gas discharge or escape channels.

The preferred embodiment of the electrode of the invention effects an escape of the gas bubbles, accumulating in the slots, at the side of the electrode at which the slots have the greatest depth whereby, due to the gas flow as well as the hydrostatic pressure difference in the cell, a fresh circulation flow transporting brine depleted of gas bubbles from the upper surface of the electrode to the underside thereof is produced, which simultaneously entrains gas bubbles that have formed at the underside of the electrode. The shortened duration of the gas bubbles leads to a reduction of the detrimental covering of gas on the electrode surface and thereby to a reduction of the voltage drop due to gas bubble polarization. The slope or inclination of the slots which, depending upon the respective current density, results in a maximal circulation effect, and the most advantageous slot volume can be determined by simple tests. The slot volume is directly proportional to the employed current density or to the quantity of gas formed in the unit of time, the slot inclination for anodes used in horizontal quicksilver-cells being substantially 1° to 15°. Still greater inclincation angles produce no additional advantages because, with increasing cross section of the slot outlet, the flow velocity and therewith the electrolyte circulation reduces. The disposition of a shield secured to the side of the electrode having the greatest slot depth and extending just short of the surface of the electrolyte, and through which a slot-shaped channel is formed between shield and cell wall or between the shields of two adjacent electrodes, produces an additional circulation-intensifying impetus.

The production of slotted forms of electrodes of solid metals, such as titanium, for example, demands a high machining or other processing expense and requires high material losses. Metal sheets, such as titanium sheets, for example, are not suited for these advantageous forms of electrodes because of unsatisfactory mechanical stability. Furthermore, the slot lengths of electrodes of a material that is not dimensionally stable, such as graphite, for example, is shortened due to burn-off or abrasion in the course of the electrolysis process, the circulation effect becoming increasingly lower as the operating period increases.

Electrodes according to the invention are suited for electrolyses of all types, for example for aqueous alkali chloride electrolysis, the electrolysis of hydrochloric acid and of water, and they are suited for carrying out organic oxidation and reduction processes, as anodes for cathodic corrosion protection, for fuel cells and galvanic cells.

Following are different examples of the method of producing the electrode of the invention:

EXAMPLE 1

Titanium powder with a grain size $< 0.06$ μm and rutile $TiO_2$ powder with a grain size $< 0.01$ μm were premixed in a high-speed blade mixer, 5 parts by weight of a 2% aqueous polyvinyl alcohol solution was added thereto, and the mixture was then mixed for an additional 10 minutes. The ratio of Ti-powder to $TiO_2$ powder was 7 : 1 to 1 : 3. The resultant mixture was compressed in a forging press at a pressure of 2 $Mp/cm^2$ into cylindrical members having a diameter of 100 mm and a height of 50 mm, which were initially dried at a temperature of 105° C and then heated and sintered in argon at 1250° C.

The cylinders were then provided by flame-spraying with a platinum layer having a mean thickness of about 5 μm, the adhesive strength of which was tested by quenching the cylinders that had been heated to 200° C in water of about 18° C. In comparison, coated cylinders of oxygen-free titanium, after quenching only three to five times, already exhibited local cracks or ruptures in the covering layer; with cylinders having the composition $TiO_x$, wherein $0.25 < x < 0.42$ and wherein $0.60 < x < 1.50$, the first very small defects were able to be observed after quenching more than ten times; and the covering layer of cylindrical members of the composition $TiO_x$, wherein $x = 0.42$ to 0.60 remained free of defects even after being quenched twenty times. A further advantage of members having an oxygen-content of from 0.42 to 0.60 is the relatively low specific electrical resistance thereof, whereas members having an oxygen content $x > 1.50$ are little suited for electrodes because of their high electrical resistance.

EXAMPLE 2

61.4 parts by weight of titanium powder, having a grain size < 0.06 μm, and 38.6 parts by weight of rutile powder, having a grain size < 0.01 μm, the mol ratio being about 8 : 3, after an addition thereto of 5 parts by weight of a 2% aqueous solution of polyvinyl alcohol, were mixed in a high-speed mixer for 10 minutes, and then compressed in a forging press at a pressure of about 50 kp/cm$^2$ into cylindrical members having a diameter of 50 mm. The pre-cast members were then dried at a temperature of 105° C, heated within four hours in an argon atmosphere at 1250° C, then were comminuted in a jaw crusher and ground in a vibratory mill to a grain size < 0.06 μm. The brittle, gray cast iron-colored powder had a composition of $TiO_{0.56}$.

5 parts by weight of a 10%-solution of hard paraffin in toluene were added to 100 parts by weight of powder, which was then mixed for 5 minutes in a turbulence mixer, and the mixture subsequently compressed in a forging press at a pressure of 2.5 Mp/cm$^2$ into plates having dimensions of 350 × 450 × 10 mm and provided on one side thereof with ribs and cylindrical recesses having a diameter of 2.5 mm. The plates were then dried at 110° C, and heated in a pass-through furnace in an argon atmosphere to 1300° C for a period of three hours. The electrical resistance of the densely sintered plates provided with a metallic polish was about 1.8 Ωmm$^2$/m, the available pore volume was about 15%.

The plates provided as anode bases for alkali chloride electrolyte cells were coated, on the side thereof facing the electrolyte bath, with acidic alcoholic solutions of 10 Mol% $RuCl_3(H_2O)_{1.5}$ and 10 Mol% $H_2PtCl_6$, and heated in an argon atmosphere to 700° C to burn or bake in the covering layer. After cooling, the plates were coated with an alcoholic solution of 25 Mol% $RuCl_3(H_2O)_{1.5}$ and then heated in steam-saturated air to 650° C. The very adhesive, dark gray-to-black covering layer contained about 1.4 mg/cm$^2$ noble metal.

The plates were tested as anodes in an alkali chloride-amalgam cell. The brine contained about 300 g/l NaCl, the temperature was 80° C and the spacing between electrodes was 2 mm. The plates were, respectively, subjected to current densities of 10,000 to 20,000 A/m$^2$ for 200 hours, and then microscopically examined for changes in the covering layer. No damage to or loss of the covering layer material was observed. The anode potential measured by the Haber-Luggin capillary was 1.33 V with respect to a normal hydrogen electrode and also remained unchanged.

EXAMPLE 3

37.5 parts by weight of titanium powder and 62.5 parts by weight of rutile powder, the molar ratio being about 1 : 1, was mixed with 5 parts by weight of an aqueous polyvinyl alcohol solution as in the foregoing Example 2, compressed, dried and then heated in an argon atmosphere to 1300° C. The resulting pre-molded members having the mole ratio Ti : oxygen of 1 : 1 were broken up, the fraction thereof having a width of 2 to 8 mm was separated by a sieve, a 5% solution of a mineral wax in benzene was added thereto, and the fraction and additive were then mixed and compressed with a pressure of 1.5 Mp/cm$^2$ into plates having the dimensions 300 × 200 × 8 mm. A rib-like pattern was simultaneously impressed into the surface thereof. The plates were then sintered for three hours at a temperature of 1250° C in a pure argon atmosphere. The pore volume of the plates were about 40%, and the mean pore diameter was about 2 mm. The plates were then provided by flame-spraying with a 0.9 μm thick equimolecular platinum-iridium covering layer and heated in argon to 700° C to burn or bake-in the layer.

The plates were tested as anodes in a diaphragm test cell for producing chlorine and soda lye at a current density of 6 kA/m$^2$ and a brine temperature of 70° C. The loss of noble metal was less than 0.1 g/t (grams per ton) of chlorine produced.

EXAMPLE 4

61.4 parts by weight of titanium powder having a grain size < 0.06 μm and 38.6 parts by weight of rutile powder having a grain size < 0.01 μm, the molar ratio thereof being about 8 : 3, were mixed in a high-speed mixer for 10 minutes after the addition thereto of 5 parts by weight of a 2% aqueous polyvinyl alcohol solution, and then compressed in a forging press at a pressure of about 50 kp/cm$^2$ into cylindrical members having a diameter of 50 mm. The thus-formed pre-molded members were dried at a temperature of 105° C, were heated in an argon atmosphere to 1250° C for four hours, then comminuted in a jaw crusher, and ground to a grain size < 0.06 μm in a vibratory mill. The brittle, grey cast-iron colored powder has a composition of $TiO_{0.56}$. The powder was then placed in a die and covered with a layer of titanium powder having a grain size < 0.1 mm. The powder layers were then compressed with a pressure of 2.5 Mp/cm$^2$ into plates having the dimensions 350 × 450 × 10 mm and having on one side thereof ribs and cylindrical recesses with a diameter of 2.5 mm, and the $TiO_x$-sides of the plates were coated with an acidic alcoholic solution of 10 Mol% $RuCl_3(H_2O)_{1.5}$ and 10 Mol % $H_2PtCl_6$, then dried at 110° C and thereafter heated in a pass-through furnace in an argon atmosphere to 1300° C, the dwell time therein being 3 hours. After cooling, the plates were coated with an alcoholic solution of 25 Mol% $RuCl_3(H_2O)_{1.5}$ and then heated in steam-saturated air to 650° C.

With respect to the foregoing example, welding of the current or power-supply rods of titanium to the titanium side of the electrode base was effected according to the metal-inert gas method with titanium fusing electrodes, according to the tungsten-inert-gas method with titanium as additive material, and according to the resistance welding method respectively under argon as protective gas. The connections produced in accordance with the welding operation were free of cracks or tears, and the few millivolts voltage-drop between the base and the current- or power-supply rods remained constant when employing the electrodes in an alkali chloride electrolyte cell.

Other features which are considered as characteristic for the invention are set forth in the appended claims.

Although the invention is illustrated and described herein as electrode for electrochemical processes and method of producing the same, it is nevertheless not intended to be limited to the details shown, since various modifications may be made therein without departing from the spirit of the invention and within the scope and range of equivalents of the claims.

The invention, however, together with additional objects and advantages thereof will be best understood from the following description when read in connection with the accompanying drawing, in which:

DESCRIPTION OF THE DRAWING

FIG. 2 is a diagrammatic perspective view of an electrode according to the invention having parallel top and bottom surfaces;

FIG. 3 is a view similar to that of FIG. 2 showing another embodiment of the electrode having an inclined upper surface.

Figure 1:
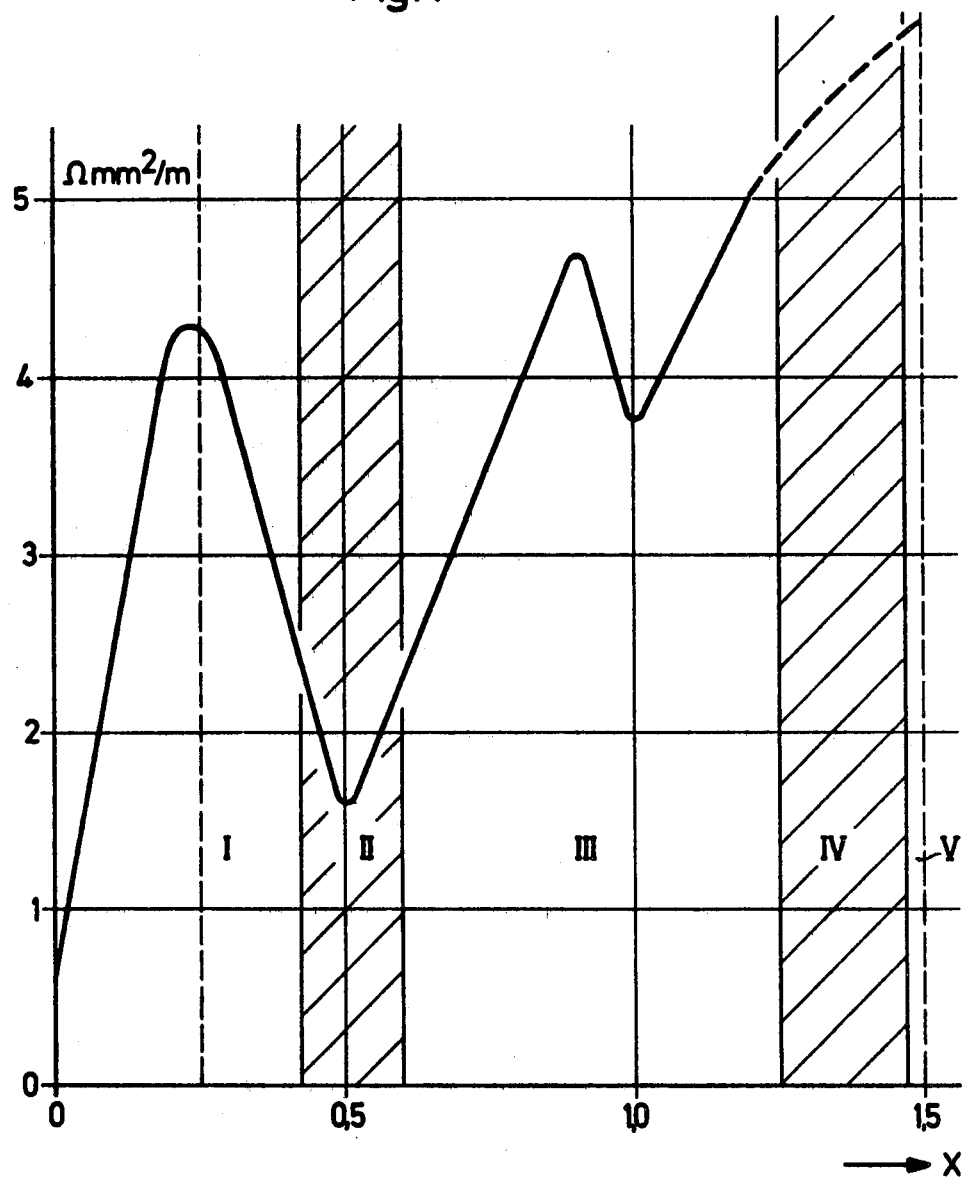
FIG. 1 is a plot diagram of the electrical resistance of $TiO_x$.

Referring now to the drawing and first, particularly to FIG. 1 thereof, there is shown a plot diagram of the specific electrical resistance of a cylindrical electrode constructed in accordance with the invention against the oxygen content thereof. The resistance increases at a constant rate from virtually oxygen-free titanium, passes through a maximum at $x = 0.25$ and decreases at a constant rate to a minimum at $x = 0.50$. In region I of FIG. 1, there is under consideration an $\alpha$-Ti addition mix-crystal with oxygen held in octahedral gaps or vacancies, in region III the compound TiO is stable, the points of the lattice structure thereof being incompletely occupied. The resistance increases in the latter region and passes through an intermediate maximum and minimum at $x = 0.9$ and $x = 1.0$, respectively. In the region II, which extends between $x = 0.42$ and $x = 0.60$, the disrupted $\alpha$-Ti and TiO-phases occur side-by-side. In the regions IV and V wherein the resistance further increases, there are presented, finally, mixtures of TiO and $Ti_2O_3$ and $Ti_2O_3$, respectively.

An electrode 1 of sintered titanium oxide $TiO_x$, according to the invention, is shown in FIG. 2. The covering layer containing activating material as well as the connection of the electrode to the current or power source is not illustrated in the figure. Inclined slots 2 extend from one side 3 to the opposite side 4 of the electrode 1, at an inclination to the bottom surface of the electrode 1, the slots 2 being deepest at the side 3 of the electrode.

The embodiment of the electrode 1', according to the invention, shown in FIG. 3, has an upper surface 5 that is inclined with respect to the lower surface thereof, as viewed in that figure, whereas the corresponding surfaces in the embodiment of FIG. 2 extend substantially parallel to one another. With respect to cost of material, the embodiment of FIG. 3 is more advantageous over that of FIG. 2. The inclination of the upper surface 5 expediently corresponds to the inclination of the slots 2 formed in the lower surface. A titanium shield or plate 6 is secured by any suitable means such as welding, to the side 4 of the electrode 1' to increase the upward drive of the gas bubbles, and extends up to just below the non-illustrated surface of the electrolyte in a cell wherein the electrode 1' is received.

Figure 4:
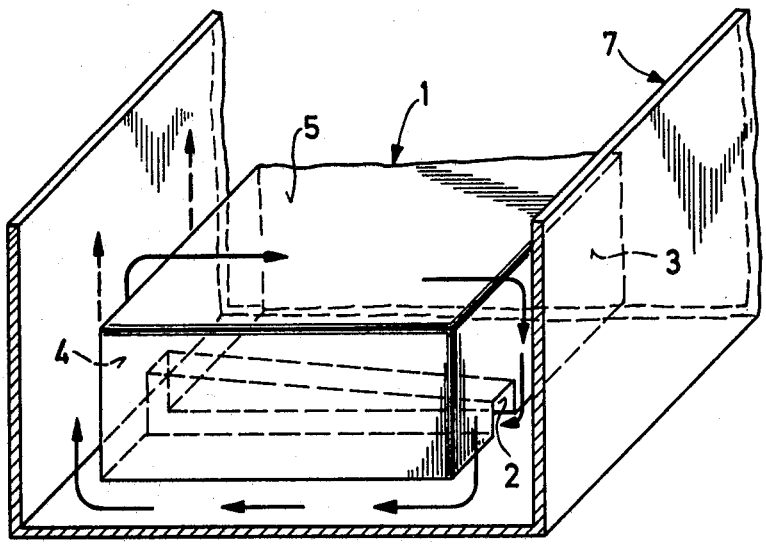
FIG. 4 is another diagrammatic perspective view of the embodiment of FIG. 2 in a cell and showing the direction of flow of brine or electrolyte and gas bubbles.

In FIG. 4, there is shown a trough 7, filled with non-illustrated electrolyte wherein the electrode 1 of FIG. 2 is immersed. The gas bubbles rising at the side 4 of the electrode 1, as represented by the upwardly directed arrows located thereat, effect a displacement of the spent electrolyte in the same direction, while fresh, gas-bubble-free brine or electrolyte flows downwardly from the upper side 5 of the electrode 1 as shown by the arrows on the right-hand side 3 of the electrode 1, takes the place of the gas bubbles that had formed at the underside of the electrode 1, and rises as gas-bubble-enriched brine between the left-hand surface 4 and the wall of the trough 7 adjacent to and spaced therefrom.

The voltage drop of a horizontal alkali chloride cell with quicksilver i.e. mercury, cathode and an anode in the embodiment of FIG. 2 was 4.0 to 4.1 $v$ for a current density of 10 $kA/m^2$ and a K-value of 0.09 $vm^2/kA$. Under the same conditions, the voltage drop of a cell with an anode formed of a succession of parallel-disposed vertical titanium bands was 4.25 to 4.30 $v$.

We claim:

1. In apparatus for aqueous electrolysis in which aqueous electrolyte is contained in a chamber and an electrode is immersed in the squeous electrolyte and a current supply rod connected to the electrode, the improvement which comprises the electrode having a base formed of passivatable material, and a covering layer of activating substance at least partly covering said base, the material of said base consisting of titanium oxide $TiO_x$, wherein $x = 0.25$ to 1.50, said material of said base having been sintered in an inert gas atmosphere to a temperature of 1200° C to 1400° C.

2. Apparatus according to claim 1, wherein said electrode base has a surface facing away from said covering layer, said surface having a layer of sintered titanium.

3. Apparatus according to claim 2, wherein said current supply rod is secured to said base at said surface of titanium.

4. Apparatus according to claim 1, wherein said electrode has a rectangular bottom surface formed with a series of slots of uniformly increasing depth extending from one side of the electrode to the opposite side thereof.

5. Apparatus according to claim 4, wherein said slots are defined by surfaces of the electrode extending vertically along respective edges formed at the bottom surface thereof, said edges formed between said vertical surfaces of said slots and said bottom surface being rounded.

6. Apparatus according to claim 4 including a shield mounted at the side of the electrode at which said slots are deepest and extending a given vertical distance so as to be just below a desired electrolyte surface level.

7. Apparatus according to claim 1, wherein $x = 0.42$ to 0.6.

8. Apparatus according to claim 1, wherein 20 to 50% by volume of said base is formed with pores having a mean diameter of from 0.5 to 5 mm.

9. Apparatus according to claim 1, wherein the electrode has a top surface inclined with respect to the bottom surface thereof.

10. Apparatus according to claim 1 wherein said electrode base is formed with an upper, a lower and at least one lateral surface, at least one of said surfaces being formed with rib-like reinforcing members.

* * * * *

UNITED STATES PATENT AND TRADEMARK OFFICE

CERTIFICATE OF CORRECTION

PATENT NO. : 4,078,988

DATED : March 14, 1978

INVENTOR(S) : FRANZ BRANDMAIR, OTTMAR RUBISCH and DIETMAR HÖNIG

It is certified that error appears in the above-identified patent and that said Letters Patent are hereby corrected as shown below:

The patent number on Sheet 1 of 3 of the drawings is incorrectly printed as "7,078,988". The patent number should read --4,078,988--.

Signed and Sealed this

*Twenty-fourth* Day of *October 1978*

[SEAL]

*Attest:*

RUTH C. MASON
*Attesting Officer*

DONALD W. BANNER
*Commissioner of Patents and Trademarks*